US008947301B2

(12) United States Patent
Nghiem et al.

(10) Patent No.: US 8,947,301 B2
(45) Date of Patent: Feb. 3, 2015

(54) MULTI-BAND LOADED ANTENNA

(75) Inventors: David Nghiem, Shoreview, MN (US); Peter J. Musto, Prior Lake, MN (US); Larry D. Canady, Ham Lake, MN (US); Keith R. Maile, New Brighton, MN (US)

(73) Assignee: Cardiac Pacemakers, Inc., St. Paul, MN (US)

( * ) Notice: Subject to any disclaimer, the term of this patent is extended or adjusted under 35 U.S.C. 154(b) by 230 days.

(21) Appl. No.: 13/537,822

(22) Filed: Jun. 29, 2012

(65) Prior Publication Data

US 2013/0009838 A1 Jan. 10, 2013

Related U.S. Application Data

(60) Provisional application No. 61/504,950, filed on Jul. 6, 2011, provisional application No. 61/504,954, filed on Jul. 6, 2011.

(51) Int. Cl.

| | |
|---|---|
| ***H01Q 1/38*** | (2006.01) |
| ***H01Q 9/42*** | (2006.01) |
| ***H01Q 5/00*** | (2006.01) |

(52) U.S. Cl.

CPC ..... *H01Q 9/42* (2013.01); *H01Q 5/0051* (2013.01)

USPC ..... 343/700 MS; 343/718; 29/600

(58) Field of Classification Search

USPC ..... 343/700 MS, 718, 702; 29/600

See application file for complete search history.

(56) References Cited

U.S. PATENT DOCUMENTS

| | | | | |
|---|---|---|---|---|
| 3,014,216 | A | 12/1961 | Yaru | |
| 3,167,775 | A | 1/1965 | Guertier | |
| 5,929,825 | A | 7/1999 | Niu et al. | |
| 6,008,762 | A | 12/1999 | Nghiem | |
| 6,054,955 | A | 4/2000 | Schlegel, Jr. et al. | |
| 6,114,996 | A | 9/2000 | Nghiem | |
| 6,353,443 | B1 * | 3/2002 | Ying | 715/702 |
| 7,119,748 | B2 | 10/2006 | Autti | |
| 7,183,984 | B2 | 2/2007 | Jarmuszewski et al. | |
| 7,199,762 | B2 | 4/2007 | Liu et al. | |

(Continued)

FOREIGN PATENT DOCUMENTS

| | | | |
|---|---|---|---|
| EP | 2729989 | A1 | 5/2014 |
| GB | 1318621 | A1 | 5/1973 |

(Continued)

OTHER PUBLICATIONS

"International Application Serial No. PCT/US2012/044867, International Search Report mailed Oct. 10, 2012", 4 pgs.

(Continued)

*Primary Examiner* — Tan Ho

(74) *Attorney, Agent, or Firm* — Schwegman Lundberg & Woessner, P.A.

(57) ABSTRACT

A planar antenna for wireless information transfer can include a planar loading portion electrically coupled to a driven node of a wireless communication circuit, and a folded conductive strip portion coupled to the planar loading portion, the folded conductive strip portion comprising at least two segments laterally offset from each other and at least partially laterally overlapping with each other. The planar loading portion can be configured to establish a specified bandwidth of a second operating frequency range, leaving a first specified operating frequency range substantially unchanged.

20 Claims, 10 Drawing Sheets

(56) References Cited

U.S. PATENT DOCUMENTS

| | | | | |
|---|---|---|---|---|
| 7,307,591 | B2 | 12/2007 | Zheng | |
| 7,330,153 | B2 | 2/2008 | Rentz | |
| 7,466,271 | B2 | 12/2008 | Wen et al. | |
| 7,515,107 | B2 | 4/2009 | Saliga | |
| 7,535,423 | B2 | 5/2009 | Lin et al. | |
| 7,541,997 | B2 | 6/2009 | Baliarda et al. | |
| 7,928,914 | B2 | 4/2011 | Bit-Babik et al. | |
| 2002/0093456 | A1 | 7/2002 | Sawamura et al. | |
| 2003/0016177 | A1 | 1/2003 | Deguchi et al. | |
| 2004/0178957 | A1 | 9/2004 | Chang et al. | |
| 2005/0040990 | A1 | 2/2005 | Yeh | |
| 2006/0020300 | A1 | 1/2006 | Nghiem et al. | |
| 2006/0122665 | A1 | 6/2006 | Nghiem et al. | |
| 2006/0132361 | A1 | 6/2006 | Lee | |
| 2006/0240869 | A1 | 10/2006 | Nghiem et al. | |
| 2007/0040761 | A1 | 2/2007 | Waterhouse | |
| 2008/0198075 | A1 | 8/2008 | Yoshioka | |
| 2008/0284653 | A1 | 11/2008 | Rikuta et al. | |
| 2009/0079638 | A1 | 3/2009 | Yoshioka | |
| 2009/0219215 | A1 | 9/2009 | Huber et al. | |
| 2011/0134011 | A1 | 6/2011 | Yamagajo | |
| 2013/0009839 | A1 | 1/2013 | Nghiem et al. | |
| 2014/0085160 | A1* | 3/2014 | Valkonen et al. | 343/860 |

FOREIGN PATENT DOCUMENTS

| | | | |
|---|---|---|---|
| JP | 2000244219 | A | 9/2000 |
| JP | 2005094501 | A | 4/2005 |
| JP | 2007028213 | A | 2/2007 |
| JP | 4234616 | B2 | 3/2009 |
| JP | 2011517158 | A | 5/2011 |
| WO | WO-2004062033 | A1 | 7/2004 |
| WO | WO-2009082175 | A2 | 7/2009 |
| WO | WO-2013006416 | A1 | 1/2013 |
| WO | WO-2013006419 | A1 | 1/2013 |

OTHER PUBLICATIONS

"International Application Serial No. PCT/US2012/044867, Written Opinion mailed Oct. 10, 2012", 4 pgs.

"International Application Serial No. PCT/US2012/044878, International Search Report mailed Oct. 9, 2012", 5 pgs.

"International Application Serial No. PCT/US2012/044878, Written Opinion mailed Oct. 9, 2012", 4 pgs.

U.S. Appl. No. 13/537,873, Notice of Allowance mailed Jun. 4, 2014, 10 pgs.

"International Application Serial No. PCT/US2012/044867, International Preliminary Report on Patentability mailed Jan. 16, 2014", 6 pgs.

"International Application Serial No. PCT/US2012/044878, International Preliminary Report on Patentability mailed Jan. 16, 2014", 6 pgs.

"Japanese Application Serial No. 2014-519132, Office Action mailed Jun. 3, 2014", With English Translation, 7 pgs.

"Japanese Application Serial No. 2014-519132, Response filed Aug. 11, 2014 to Non Final Office Action dated Jun. 3, 2014", With English Claims, 9.

"Japanese Application Serial No. 2014-519131, Office Action mailed Dec. 2, 2014", with English translation, 5 pgs.

* cited by examiner

MULTI-BAND LOADED ANTENNA

CLAIM OF PRIORITY

This application claims the benefit of priority under 35 U.S.C. §119(e) of Nghiem et al., U.S. Provisional Patent Application Ser. No. 61/504,950, entitled "MULTI-BAND LOADED ANTENNA", filed on Jul. 6, 2011, and this application also claims the benefit of priority under 35 U.S.C. §119(e) of Nghiem et al., U.S. Provisional Patent Application Ser. No. 61/504,954, entitled "MULTI-BAND MULTI-POLARIZATION STUB-TUNED ANTENNA", filed on Jul. 6, 2011, each of which is hereby incorporated by reference herein in its respective entirety.

BACKGROUND

Medical devices can perform tasks including monitoring, detecting, or sensing physiological information, diagnosing a physiological condition or a disease, treating or providing a therapy for a physiological condition or disease, or restoring or otherwise altering physiologic function. For example, such medical devices include implantable devices or externally-worn ambulatory devices. An example of an implantable medical device can include a cardiac function management device, such as a pacemaker, a cardiac resynchronization therapy device, a cardioverter or defibrillator, or other device. Other medical devices can include a neurological stimulator, a neuromuscular stimulator, a drug delivery system, or one or more other devices.

Generally, a medical device can include a wireless communication circuit (e.g., a telemetry circuit) and an antenna coupled to the wireless communication circuit, to provide wireless communication between the medical device and another assembly, such as to send information (e.g., physiological or other information) from the medical device to another assembly, or to receive information (e.g., programming instructions, operational parameters, or other information) from another assembly. Mutual inductive coupling can be used to provide short-range communication between an implantable medical device implanted in a body and an external assembly, or between a medical device outside of the body and an external assembly.

Communication via mutual inductive coupling largely relies on low frequency near-field coupling, where the field distribution is highly dependent upon the distance from, and orientation of, the antenna. Such mutual inductive coupling can grossly limit the range of wireless communication between the implantable medical device and the external assembly, generally to a range of a few centimeters.

OVERVIEW

Low power radio frequency ("RF") electromagnetic radiation can be used to provide communication between an ambulatory or implantable medical device and another assembly, such as in addition to or instead of using mutual-inductive coupling for such communication. Generally, an antenna included as a portion of an implantable or external assembly can be configured for use within a relatively narrow range of frequencies (e.g., a narrowband antenna). Such narrowband antennas can be tuned to establish a specified input impedance within a desired or specified range of operating frequencies.

In the United States, various frequency ranges are allocated for mobile radio communication, cellular data or telephone communication, satellite communication, unlicensed low-power communication for industrial, scientific, or medical use, or for licensed low-power medical device communication. Such frequency ranges generally constrain the physical design of the antenna. Thus, during design or manufacturing, several different antenna designs might be used depending on the intended application, manufacturing, or end use location of the apparatus including the antenna.

The present inventors have recognized, among other things, that manufacturing cost or complexity can be reduced by using an antenna configured for operation within multiple ranges of frequencies (e.g., a multi-band antenna). For example, a multi-band antenna can perform the function of various separate antennas, such as reducing or eliminating a need for providing different antenna sizes or configurations during manufacturing to suit differing end uses or locations. The present inventors have also recognized that such a multi-band antenna can be fabricated using printed circuit board (PCB) materials or techniques. For example, a planar multi-band antenna can be included as a portion of a printed circuit board assembly that can also include other circuitry. In an example, the planar multi-band antenna can be housed in a display portion of an external assembly, or on or within a housing of the assembly.

In an example, a planar antenna for wireless information transfer can include a planar loading portion electrically coupled to a driven node of a wireless communication circuit, and a folded conductive strip portion coupled to the planar loading portion. In an example, the folded conductive strip portion can include an "inverted-L" or other configuration, such as can include at least two segments laterally offset from each other and at least partially laterally overlapping with each other. The planar loading portion can be configured to establish a specified bandwidth of a second operating frequency range, leaving a first specified operating frequency range substantially unchanged.

In an example, a planar antenna can include a folded conductive strip portion coupled to a driven node of a wireless communication circuit, the folded conductive strip portion comprising at least two segments laterally offset from each other and at least partially laterally overlapping with each other, and a first region oriented along a first axis in a plane of the planar antenna and a second region oriented along a second axis in the plane of the planar antenna, the two axes and the two regions specified to provide polarization diversity of radiation from the planar antenna. For example, the planar antenna can include a stub coupled to the folded conductive strip portion, the stub configured to provide a first specified operating frequency range at or near resonance using a mode corresponding to a total physical path length along the folded conductive strip portion.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
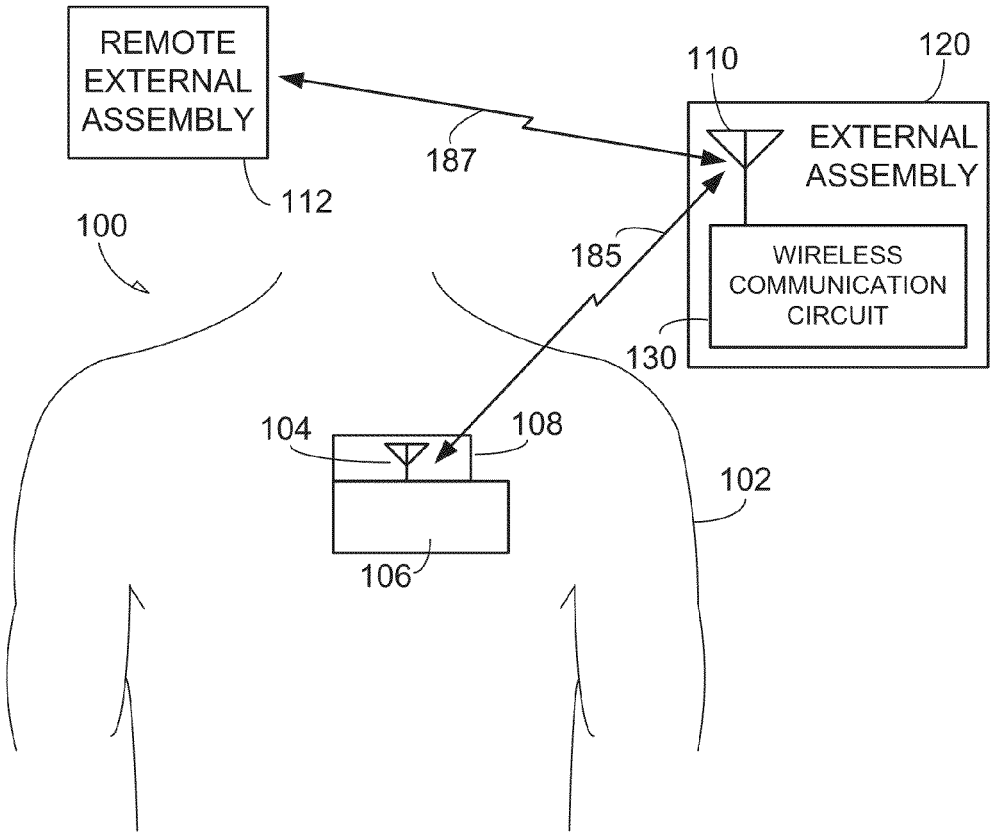
FIG. 1 illustrates generally an example of a system that can include a medical device, a local external assembly, or a remote external assembly.

FIG. 1 illustrates generally an example of a system 100 that can include a medical device 106, a local external assembly 120, or a remote external assembly 112. In FIG. 1, the medical device 106 can include an ambulatory or implantable device located within or near a patient 102, such as a cardiac function management device (e.g., a pacemaker, a cardioverter or defibrillator, a cardiac resynchronization therapy device, a monitoring device, a neural stimulation device, or the like). The medical device 106 can include a dielectric portion 108 housing an antenna 104. The antenna 104 can be configured to wirelessly transfer information electromagnetically, such as transcutaneously, to the local external assembly 120, such as via a first communicative coupling 185 using a first specified range of frequencies.

In an example, the local external assembly 120 can include a physician's programming assembly or other caregiver's programming assembly, a bedside monitor or other monitor, or other relatively nearby assembly, such as used to transfer programming instructions or configuration information to the medical device 106, or to receive diagnostic information, a disease status, information about one or more physiologic parameters, or the like, from the medical device 106. The external assembly 120 can be communicatively connected to one or more other external assemblies, such as a remote external assembly 112, located elsewhere (e.g., a server, a client terminal such as a web-connected personal computer, a cellular base-station, or another wirelessly-coupled or wired remote assembly), such as via a second communicative coupling 187. The second communicative coupling can use the first specified range of frequencies, or a second specified range of frequencies. In an example, the local external assembly 120 can include one or more antennas, such as an antenna 110 coupled to a wireless communication circuit 130. The antenna 110 can be configured to wirelessly transfer information electromagnetically using one or more of the first or second specified ranges of frequencies, such as including a multi-band planar antenna as discussed in the examples above and below.

Figure 2:
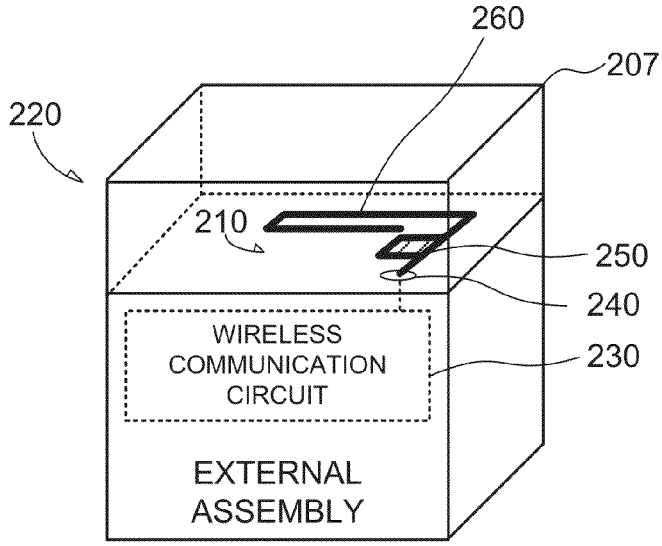
FIG. 2 illustrates generally an example of an external assembly that can include a planar multi-band antenna.

FIG. 2 illustrates generally an example of an external assembly 220 that can include a planar multi-band antenna 210. The external assembly 220 can include a programmer or monitor such as discussed in the example of FIG. 1. The external assembly 220 can include a wireless communication circuit 230 (e.g., a telemetry circuit or other communication circuit), such as configured to transfer information wirelessly via the planar antenna 220. In the example of FIG. 2, the planar antenna 210 can include a folded conductive strip portion 260, such as coupled to an antenna feed 240 via a planar loading portion 250, such as shown and discussed in the examples above and below. In an example, the folded conductive strip portion can include an "inverted-L" configuration, or one or more other configurations.

In an example, the planar antenna 210 can be located on or within a housing of the external assembly 220, such as located on or within a dielectric material 207 (e.g., a dielectric compartment, a dielectric shell, or other dielectric material that can support or surround the antenna 210). The dielectric material 207 can be specified to pass electromagnetic waves in one or more specified operating frequency ranges. Such a dielectric material 207 can include a portion of a dielectric housing, such as a base housing or a display housing of the external assembly 220. In an example, the planar antenna 210 can be located on or within a dielectric material included as a portion of a printed circuit board (PCB) assembly.

Figure 3A:
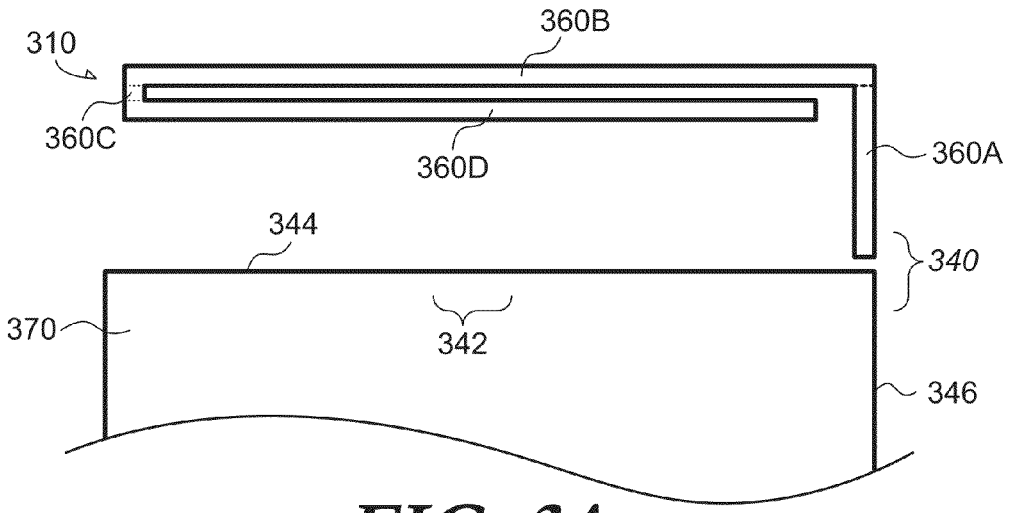
FIGS. 3A-B illustrate generally an example of a multi-band planar antenna that can be located near a planar return portion and a respective illustrative example of a simulation of a return loss corresponding to the multi-band planar antenna.
Figure 3B:
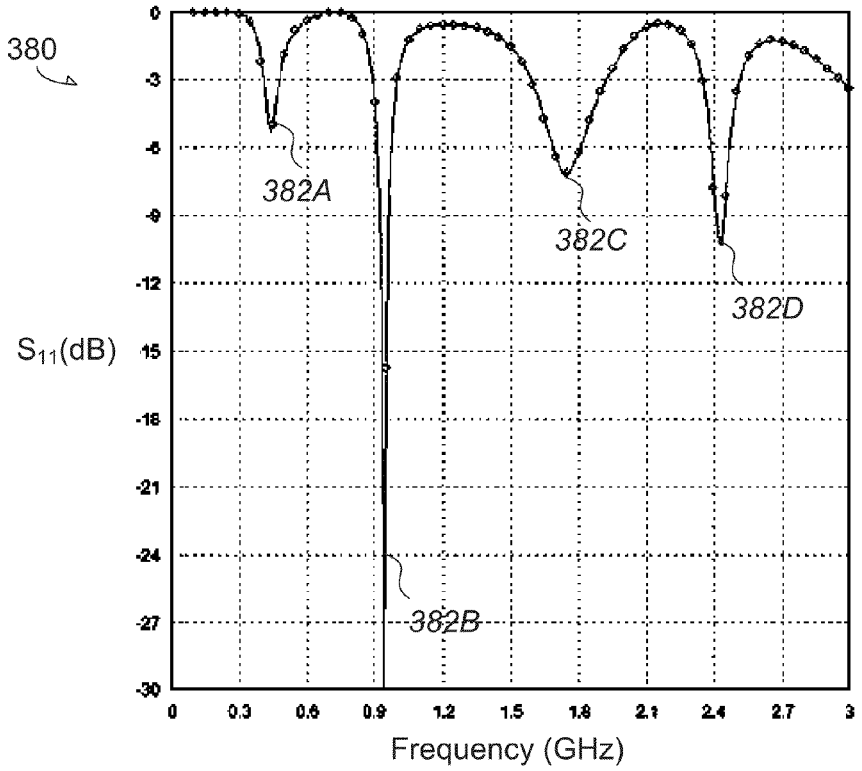

FIGS. 3A-B illustrate generally an example (e.g., a view of a planar conductive layer) of a multi-band planar antenna 310 that can be located near a planar return portion 370 and a respective illustrative example of a simulation of a return loss 380 corresponding to the multi-band planar antenna. In an example, the multi-band planar antenna 310 can be configured to provide multiple usable ranges of operating frequencies, such as including a first operating frequency range 382A centered just above about 400 MHz (e.g., including a Medical Implant Communications Service (MICS) frequency range), a second operating frequency range 382B centered just above 900 MHz (e.g., including a first Industrial, Scientific, and Medical (ISM) band), a third operating frequency range 382C centered around about 1700 MHz (e.g., including a cellular data or mobile phone frequency range), or a fourth operating frequency range 382D centered just above 2.4 GHz (e.g., including a second ISM band).

In an example, the antenna 310 can include a folded conductive strip portion such as comprising an "inverted-L" configuration, such as including a first segment 360A, that can be coupled to the driven node (e.g., a single-ended input or output) of a wireless communication circuit, such as within or nearby a feed region 340. A reference or return node of the wireless communication circuit (e.g., "RF" ground) can be coupled to the planar return portion 370, such as in the feed region 340. In an example, the folded conductive strip portion of the antenna 310 can include two parallel segments that can be laterally separated (e.g., laterally offset from each other), such as a second segment 360B and a fourth segment 360D, such as conductively coupled by a third segment 360C. The term "folded" can refer to the physical arrangement of the conductive strips with respect to each other, such as the inclusion of two parallel conductive strip portions (e.g. the second and fourth segments 360B and 360D) that can at least partially laterally overlap.

In an example, the antenna 310 can use a mode corresponding to a total physical path length along the first through fourth segments 360A through 360D, such as to establish the first frequency range 382A. Similarly, the antenna can use a mode corresponding to about half of the total physical path length along the antenna, such as to establish a higher operating frequency range (e.g., the second operating frequency range 382B). For example, the antenna 310 can support other resonances or higher-order modes, such as corresponding to the third or fourth frequency ranges 382C-D.

An antenna efficiency of the antenna 310 can be established at least in part by the location of the feed region, or by a physical length of one or more of a first lateral edge 344 of the planar return portion 370, or a second lateral edge 346 of the planar return portion 370. For example, for a corner feed location (e.g., the region 340), as the lateral edge 344 is reduced in length, the planar return portion 370 gradually approximates a second conductive strip (e.g., forming a dipole configuration). If the planar return portion 370 dimensions are reduced too much, the antenna 310 can be detuned, such as undesirably increasing return loss.

The present inventors have also recognized that the second lateral edge 346 can be extended in length away from the feed region 340 (e.g., increasing both a linear dimension of the edge 346 and a surface area of the planar return portion 370), such as to enhance an antenna efficiency of the antenna 310 as compared to using a smaller planar return portion. Similarly it is believed that the location of the antenna feed region 340 can be moved to a more central region 342 (e.g., at or near a midpoint of the lateral edge 344), such as to enhance an antenna efficiency of the antenna 310, such as when a housing for the antenna 310 can accommodate a larger planar return portion 370 length or area.

In the examples of FIGS. 3A-B, the antenna 310 configuration can provide multiple usable ranges of operating frequencies, however a return loss 380 of such a configuration can still be improved, such as using a planar loading portion as discussed in other examples above and below.

In an example, one or more criteria can be used to select or identify usable ranges of operating frequencies. For example, a return loss 380 (e.g., an $S_{11}$ parameter in decibels (dB)) can be specified as −7 dB or more negative within a usable range of frequencies (e.g., corresponding to a return loss 380 of 7 dB, or a voltage standing wave ratio (VSWR) of 2:6 or less).

An impedance matching network can be used to compensate for an input impedance of the antenna 310 that deviates from 50 ohms real, such as to provide a substantially conjugate match between the antenna 310 and an output impedance of a wireless communication circuit. However, such a matching network can add cost or complexity to the wireless communication circuitry. The present inventors have, among other things, developed techniques and apparatus to widen the bandwidth of the usable operating frequency ranges (e.g., ranges 382A through 382D), while still keeping such frequency ranges located near (e.g., centered around) desired frequencies, or providing improved impedance matching within such frequencies (e.g., generally improving the return loss 380).

In the examples of FIGS. 4A-B, 5A-B, 8, and 10, a higher-order mode can be tuned or widened to provide a desired range of operating frequencies, such as without disturbing a range of frequencies corresponding to a fundamental mode (e.g., without substantially narrowing the fundamental mode operating frequency range, or shifting a center frequency corresponding to the fundamental mode). In the examples of FIGS. 6A-B, 7A-B, 9, and 11, a fundamental mode can be tuned to provide a desired range of operating frequencies, such as without disturbing a range of frequencies corresponding to one or more higher-order modes.

Figure 4A:
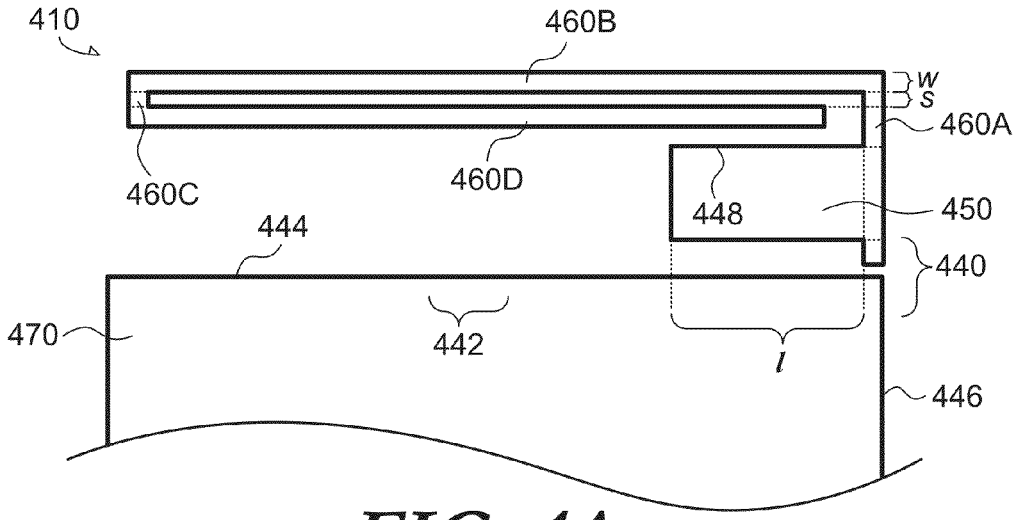
FIGS. 4A-B illustrate generally an example of a multi-band planar antenna that can include a planar loading portion and a respective illustrative example of a simulation of a return loss corresponding to the multi-band planar antenna.
Figure 4B:
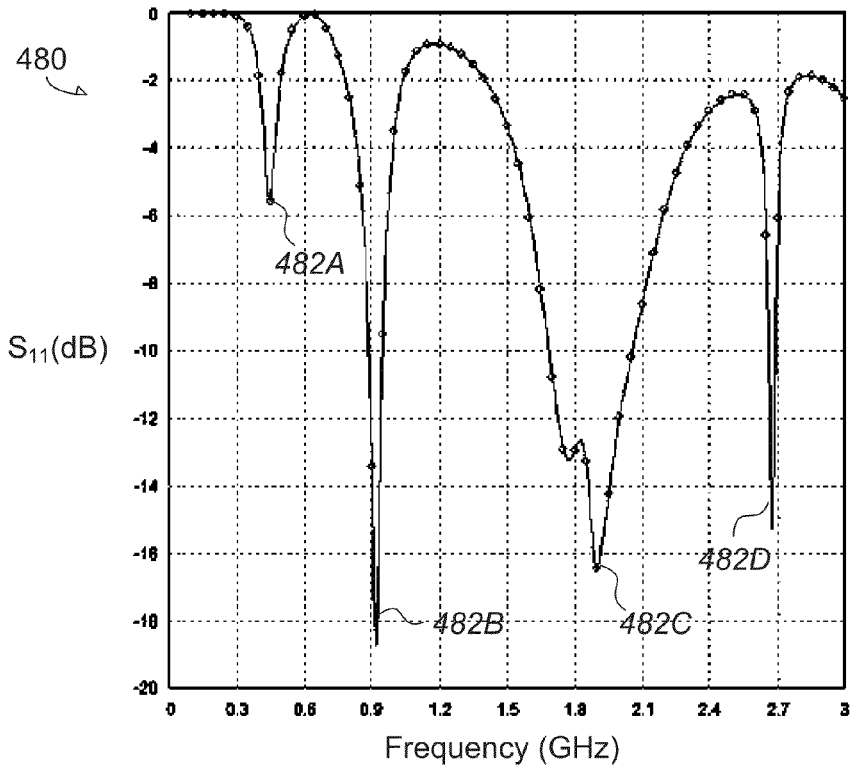

FIGS. 4A-B illustrate generally an example of a multi-band planar antenna 410 that can include a planar loading portion 450 and a respective illustrative example of a simulation of a return loss 480 (e.g., an $S_{11}$ parameter in dB) corresponding to the multi-band planar antenna 410. Similarly to the examples of FIGS. 3A-B, the antenna 410 can include a folded conductive strip portion, such as including a first segment 460A, a second segment 460B, a third segment 460C, and a fourth segment 460D. The second and fourth segments 460B and 460D can be laterally offset from each other by a specified separation "s," and one or more of the first through fourth segments 460A through 460D can include a specified physical width "w" (e.g., a lateral width of the segment). In an example, a length of the third segment 460C can establish a separation "s," and can be about equal to, or less than the physical width "w." However, "s" should generally not be so small as to cause an undesired reactive or conductive "short circuit" in the antenna 510. In an example, the first segment 460A can be less in length than about three times the physical width "w."

The planar loading portion 450 can be coupled to a driven node of a wireless communication circuit such as within or near a feed region 440. The planar loading portion 450 can include a distal edge (e.g., distal to the feed region 440), conductively coupled to the first segment 460A. The planar loading portion 450 can be wider in physical width than the physical width "w" of the folded conductive strip portions and can include a physical length, "l."

The configuration of the folded conductive strip portion (e.g., segments 460A through 460D) and the planar loading portion 450 can establish a first operating frequency range 482A centered just above about 400 MHz (e.g., including a Medical Implant Communications Service (MICS) frequency range), a second operating frequency range 482B centered just above 900 MHz (e.g., including a first Industrial, Scientific, and Medical (ISM) band), a third operating frequency range 482C centered around about 1800 MHz (e.g., including frequencies corresponding to various cellular data or mobile phone frequency ranges), or a fourth operating frequency range 382D centered just below 2.7 GHz.

The return loss 480 of FIG. 4B includes a first operating frequency range 482A that remains substantially unchanged as compared to the corresponding first operating frequency range 382A of FIG. 3B. The second operating frequency range 482B can be slightly wider than the second operating frequency 382B of FIG. 3B. In the examples of FIGS. 4A-B, the first and second operating frequency ranges 482A-B remain substantially unchanged, while the third operating frequency range 482C has been substantially widened as compared to the third operating frequency range 382C of FIG. 3B. In contrast to the examples of FIGS. 3A-B, the inclusion of the planar loading portion 450 can establish a wider third operating frequency range 482C in FIG. 4B in comparison to the corresponding frequency range 382C of FIG. 3B.

In an example, the planar loading portion 450 can include a physical length, "l" such as corresponding to about a quarter of an effective wavelength, the effective wavelength established by a frequency included in intermediate frequency range (e.g., a desired center frequency of the third operating frequency range 482C), such as located between the first operating frequency range 482A, and the fourth operating frequency range 482D. The planar loading portion 450 physical length "l" can be extended or shortened in length, such as to widen another specified operating frequency range (e.g., the second operating frequency range 482B or the fourth operating frequency range 482D). In this manner, the planar loading portion 450 can be used for tuning one or more high-order modes of the antenna 410 (e.g., corresponding to the third operating frequency range 482C) without substantially disturbing a fundamental mode of the antenna 410 (e.g., corresponding to a third operating frequency range 482A).

"Effective wavelength" can refer to the wavelength of an electromagnetic wave propagating via a structure (e.g., a transmission line or waveguide) that can be surrounded by an inhomogeneous dielectric medium. Such an inhomogeneous configuration (e.g., a PCB dielectric material on one face of the folded conductive strip portion and air or another medium on the opposite face, or including one or more other media) establishes an "effective" dielectric constant, including contributions from the different dielectric materials. Generally, the effective dielectric constant is a value between the lowest and highest values of the dielectric constants of the materials comprising the inhomogeneous configuration (e.g., a geometric mean), and the corresponding effective wavelength can be defined as inversely proportional to the square root of such an effective dielectric constant.

Figure 5A:
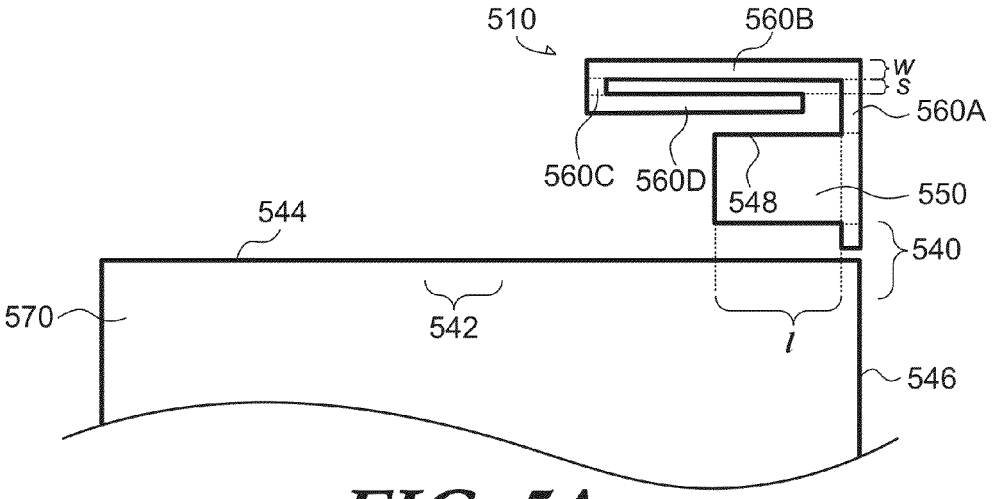
FIGS. 5A-B illustrate generally an example of a multi-band planar antenna that can include a planar loading portion and a respective illustrative example of a simulation of a return loss corresponding to the multi-band planar antenna.
Figure 5B:
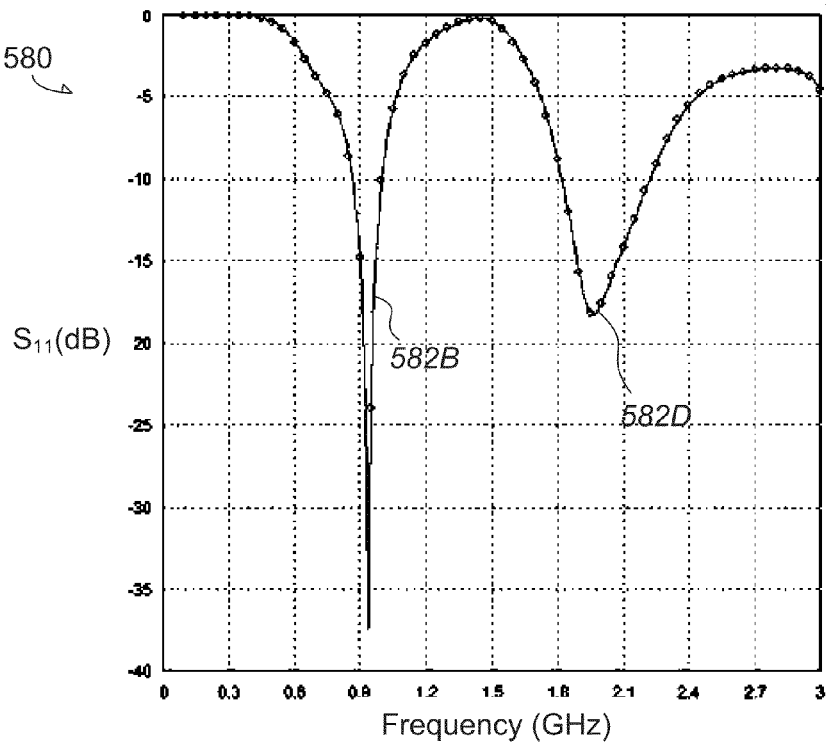

FIGS. 5A-B illustrate generally an example of a multi-band planar antenna 510 including a planar loading portion 550 and a respective illustrative example of a simulation of a return loss 580 corresponding to the multi-band planar antenna 510. The antenna 510 can include a folded conductive strip portion including a first segment 560A coupled to a distal edge 548 of the planar loading portion 550, a second segment 560B conductively coupled to the first segment 560A, a third segment 560C conductively coupled to the second segment 560B, and a fourth segment 560D conductively coupled to the third segment 560C.

As in the examples of FIGS. 4A-B, the second and fourth segments 560B and 560D can be laterally offset from each other by a specified separation "s," and one or more of the first through fourth segments 560A through 560D can include a specified physical width "w" (e.g., a lateral width of the segment). In an example, a length of the third segment 560C can establish a separation "s," and can be about equal to, or less than the physical width "w." However, "s" should generally not be so small as to cause an undesired reactive or conductive "short" in the antenna 510. In an example, the first segment 560A can be less in length than about three times the physical width "w."

As in the examples of FIGS. 3A-B and 4A-B discussed above, the antenna 510 can provide multiple usable operating frequency ranges. However, the antenna 510 can be more compact than the corresponding examples of FIGS. 3A-B and 4A-B because the first operating frequency range 382A, 482A (e.g., at just above about 400 MHz) can be omitted. The second segment 560B and the fourth segment 560D can be correspondingly shorter, as a total physical path length of the antenna 510 need not be as long as in the examples of FIG. 3A-B or 4A-B. An effective wavelength corresponding to a first operating frequency range 582B of FIG. 5B (e.g., centered just above about 900 MHz) is shorter than an effective wavelength corresponding to the first operating frequency range 382A, 482A of FIGS. 3B and 4B (e.g., centered just above about 400 MHz).

Figure 6A:
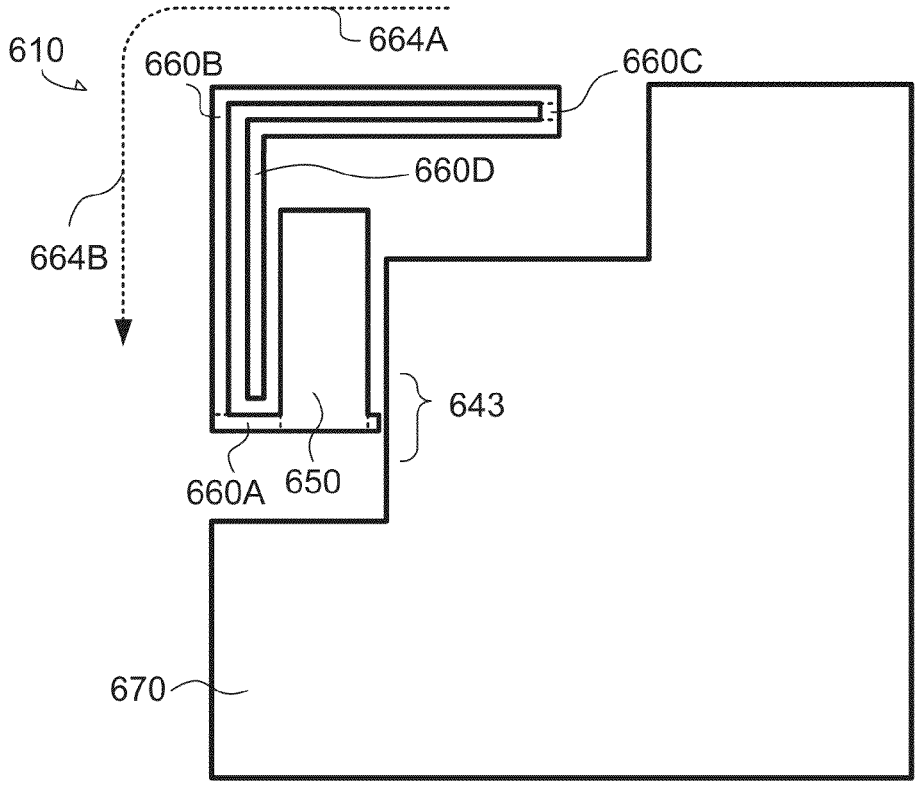
FIGS. 6A-B illustrate generally an example of a multi-band planar antenna that can include a folded conductive strip portion comprising a first region along a first axis and a second region along a second axis, and a respective illustrative example of a simulation of a return loss corresponding to the multi-band planar antenna.
Figure 6B:
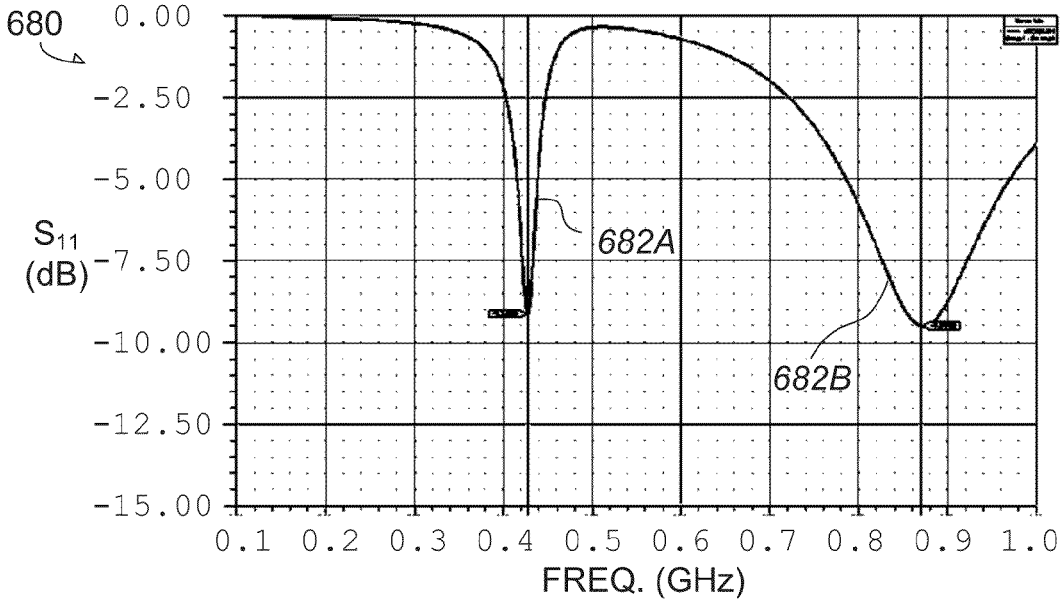

FIGS. 6A-B illustrate generally an example of a multi-band planar antenna 610, similar to the examples of FIG. 5A-B, that can include a folded conductive strip portion comprising a first region parallel to a first axis 664A and a second region parallel to a second axis 664B, and a respective illustrative example of a simulation of a return loss 680 corresponding to the multi-band planar antenna 610.

In an example, the folded conductive strip portion can include a planar loading portion 650, such as discussed in relation to other examples. In an example, the antenna 610 can include a first segment 660A, a second segment 660B, a third segment 660C, and a fourth segment 660D. In the example of FIG. 6A, the second segment 660B and the fourth segment 660D can follow a commonly-shared path including one or more bends, such as parallel to the first axis 664A in a first region and a second axis 664B in a second region. Such a configuration including a bend or a curved path can provide enhanced polarization diversity of radiation from the antenna 610 in one or more specified frequency ranges, such as compared to the examples of FIG. 4A-B or 5A-B, where the second segments 460B, 560B and the fourth segments 460D, 560D are shown aligned with (e.g., parallel to) a single axis in their respective long dimensions. While FIG. 6A includes a right-angle bend, such right angle bends are not required. In an example, the folded conductive strip portion can include other patterns, such as including multiple bends, or including an arc-shaped path.

In an example, the antenna 610 can be coupled to a driven node of a wireless communication circuit, such as at or near a feed region 643 that can be located at a lateral edge of a planar return portion 670. Similarly to the examples discussed above and below, an antenna efficiency of the antenna 610 can be enhanced as the long lateral edges of the planar return portion 670 are extended. As the dimensions of the planar return portion 670 are reduced, the planar return portion 670 can approximate a second antenna arm, such as establishing a dipole configuration. An antenna efficiency can depend, in part, on a return loss of the antenna 610. For example, a surface current distribution in the planar return portion 670 can be localized. The planar return portion 670 can be "cut," or otherwise reduced in area or length in regions lacking a significant surface current magnitude, such as to reduce an overall surface area of the antenna 610 and planar return portion 670, but without substantially degrading return loss performance in one or more desired ranges of operating frequencies.

In an illustrative example, the folded conductive strip portion comprising the first through fourth segments 660A through 660D can be bent as shown in the example of FIG. 6A. In FIG. 6B, the illustrative example of the return loss 680 includes a first range of operating frequencies 682A centered above 400 MHz, and a second specified range of operating frequencies centered at just below 900 MHz.

Figure 7A:
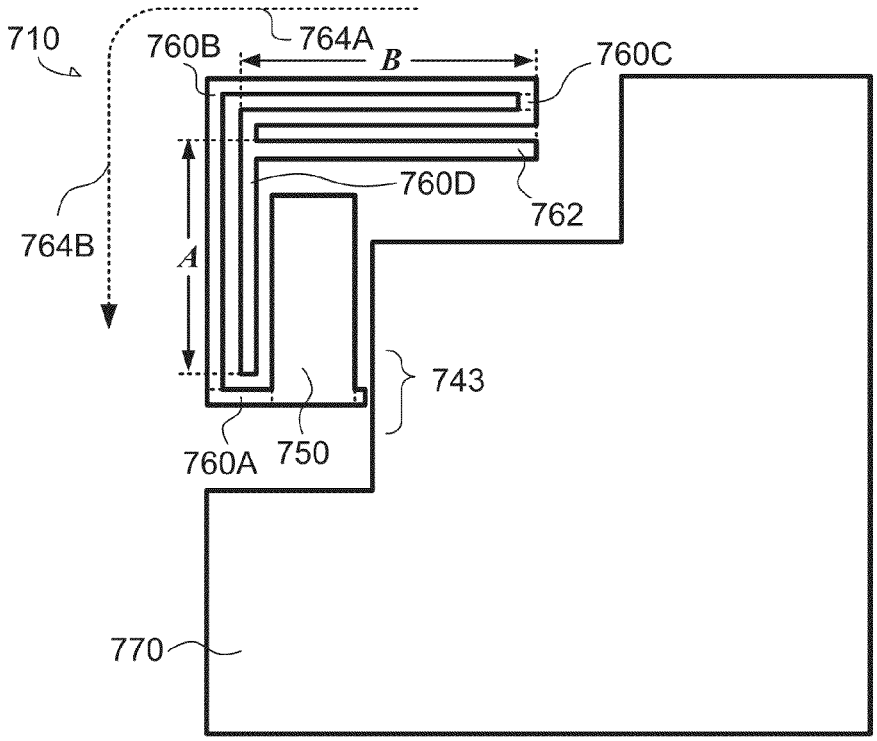
FIGS. 7A-B illustrate generally an example of a multi-band planar antenna that can include a stub, and a respective illustrative example of a simulation of a return loss corresponding to the multi-band planar antenna.
Figure 7B:
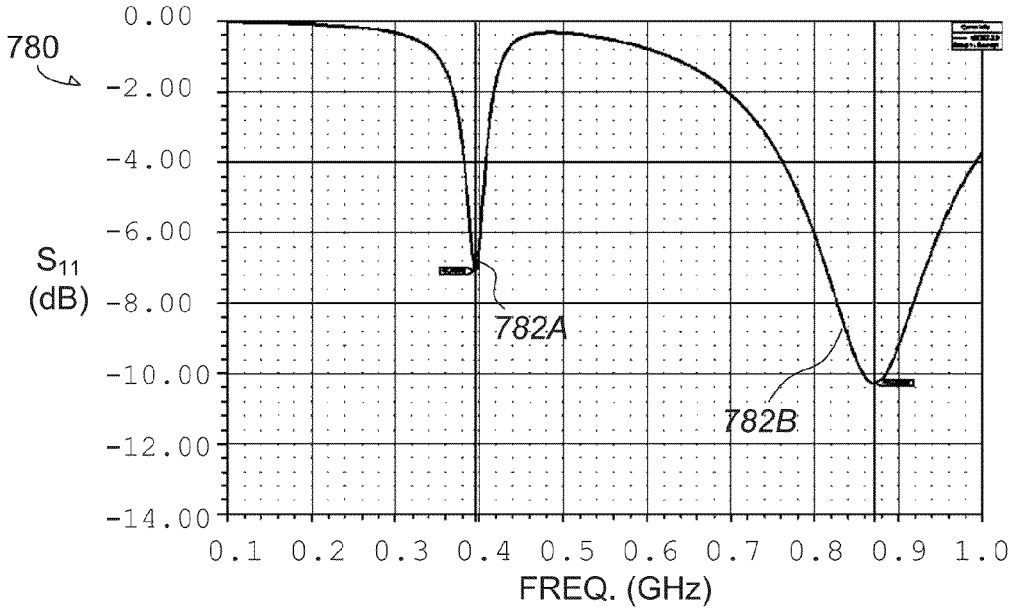

FIGS. 7A-B illustrate generally an example of a multi-band planar antenna 710 that can include a stub 762, and a respective illustrative example of a simulation of a return loss 780 corresponding to the multi-band planar antenna 710. In an example, the antenna 710 can include a planar loading portion 750, such as coupled to a driven node of a wireless communication circuit at or near a feed region 743. For example, the antenna 710 can include a folded conductive strip portion comprising first through fourth segments 760A through 760D. In an example, the first segment 760A can be coupled to the wireless communication circuit via the planar loading portion 750.

Referring back to FIG. 6B, the first range of operating frequencies 682A can be slightly offset from a desired first range of operating frequencies, such as due at least in part to including the bend in the second segment 660B, and the fourth segment 660D. The present inventors have recognized, among other things, that the stub 762 can be included to adjust or shift a resonant response to the desired range of operating frequencies, such as to provide a first specified range of operating frequencies 782A as shown in FIG. 7B. In an example, a second specified range of operating frequencies 782B can remain substantially unchanged as compared to the second range of operating frequencies 682B of FIG. 6B, even though the antenna 710 includes the stub 762.

In an illustrative example, a combination of the stub and the folded conductive strip portion can be used to provide the first specified range of operating frequencies 782A. For example, the stub 762 can be electrically coupled to the fourth segment 760D along the length of the fourth segment 760D, such as distally with respect to the third segment at just beyond a mid-point of the fourth segment 760D. A distal portion of the fourth segment can have a physical length that can be represented by "A," and the stub can have a physical length that can be represented by "B." In an example, the physical lengths, A and B, can be about equal in physical length. A total physical length of the first through fourth segments 760A through 760D can correspond to a mode supporting the first specified range of frequencies 782A such as when a polarization-enhancing bend in the second and fourth segments, 760B,D is omitted, as shown in the example of FIG. 4A. In the illustrative examples of FIGS. 6A-B, such a bend can slightly detune the antenna 610 (e.g., shifting one or more ranges of operating frequencies). In an example, the first range of frequencies 682A can be shifted to a desired range, such as to provide the first specified range of operating frequencies 782A (e.g., centered at just below about 400 MHz), the remaining distal portion physical length of the fourth segment, A, and the stub length, B, can be specified as about equal to a defined proportion of an effective wavelength, such as 1/16 of an effective wavelength, corresponding to a desired center frequency of the first specified range of frequencies 782A.

In an illustrative example, according to experimentally-obtained free-space range data, the antenna 710 of FIG. 7 can provide more than 20 dB of improvement in a magnitude of a horizontal component of the electric field intensity at 403.5 MHz in the direction of minimum intensity when scanned azimuthally in a plane parallel to the plane of the folded conductive strip portion, as compared to an antenna configuration lacking a polarization-enhancing bend region and stub 762. Such improvement indicates that one or more nulls in the horizontal response of the antenna 710 can be reduced or eliminated using the polarization-enhancing bend in the second and fourth segments 760B or 760D, such as compensating for any resultant de-tuning using the stub 762.

In an illustrative example, according to experimentally-obtained free-space range data, an average total electric field intensity of the antenna 710 can be improved by about 3 dB at 403.5 MHz including both the horizontal and vertical electric field components, when scanned azimuthally in a plane parallel to the plane of the folded conductive strip portion, such as in response to increasing a longest edge dimension of a planar return portion 770 from 3 inches to 6 inches.

It is believed that antenna performance, such as an improvement in return loss, can be realized such as by moving a feed region from a corner location of a lateral edge of the planar return 770 to a mid-point of a lateral edge of the planar return portion 770, such as if the overall dimensions of the planar return portion 770 can still support a surface current distribution having dimensions similar to the folded conductive stub portion.

Figure 8:
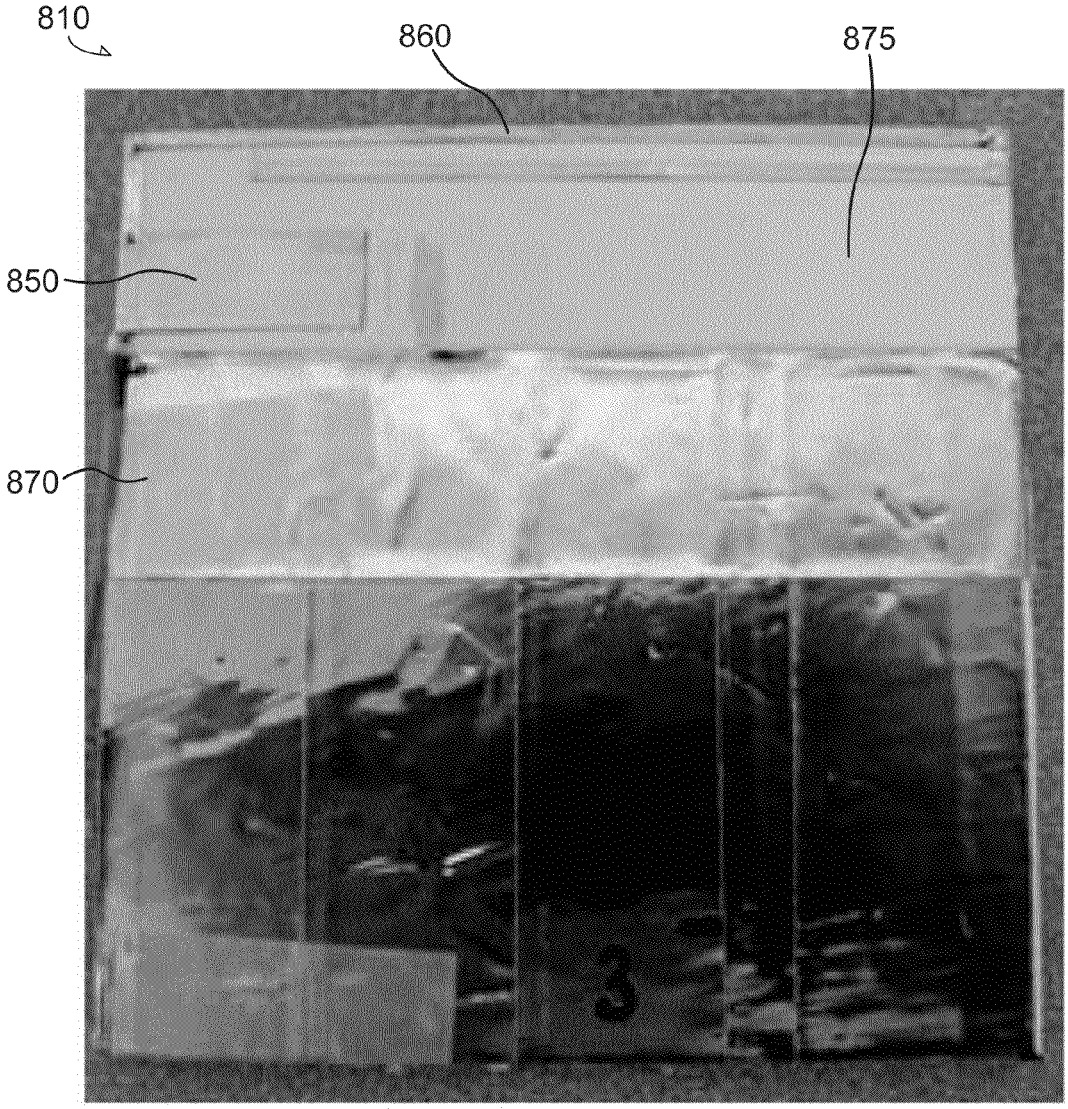
FIG. 8 includes a photograph of an illustrative example of a multi-band planar antenna that can include a planar loading portion.

FIG. 8 includes a photograph of an illustrative example of a multi-band planar antenna 810, that can include a folded conductive strip portion 860 conductively coupled to a planar loading portion 850. The antenna 810 can be located laterally nearby a planar return portion 870. One or more of the folded conductive strip portion 860, the planar loading portion 850, or the planar return portion 870 can be located on or within a planar dielectric portion 875 (e.g., a dielectric foam in the example of FIG. 8). In an example, the dielectric portion 875 can include a dielectric material layer comprising a portion of a printed circuit board (PCB) assembly, or one or more other dielectric materials.

Figure 9:
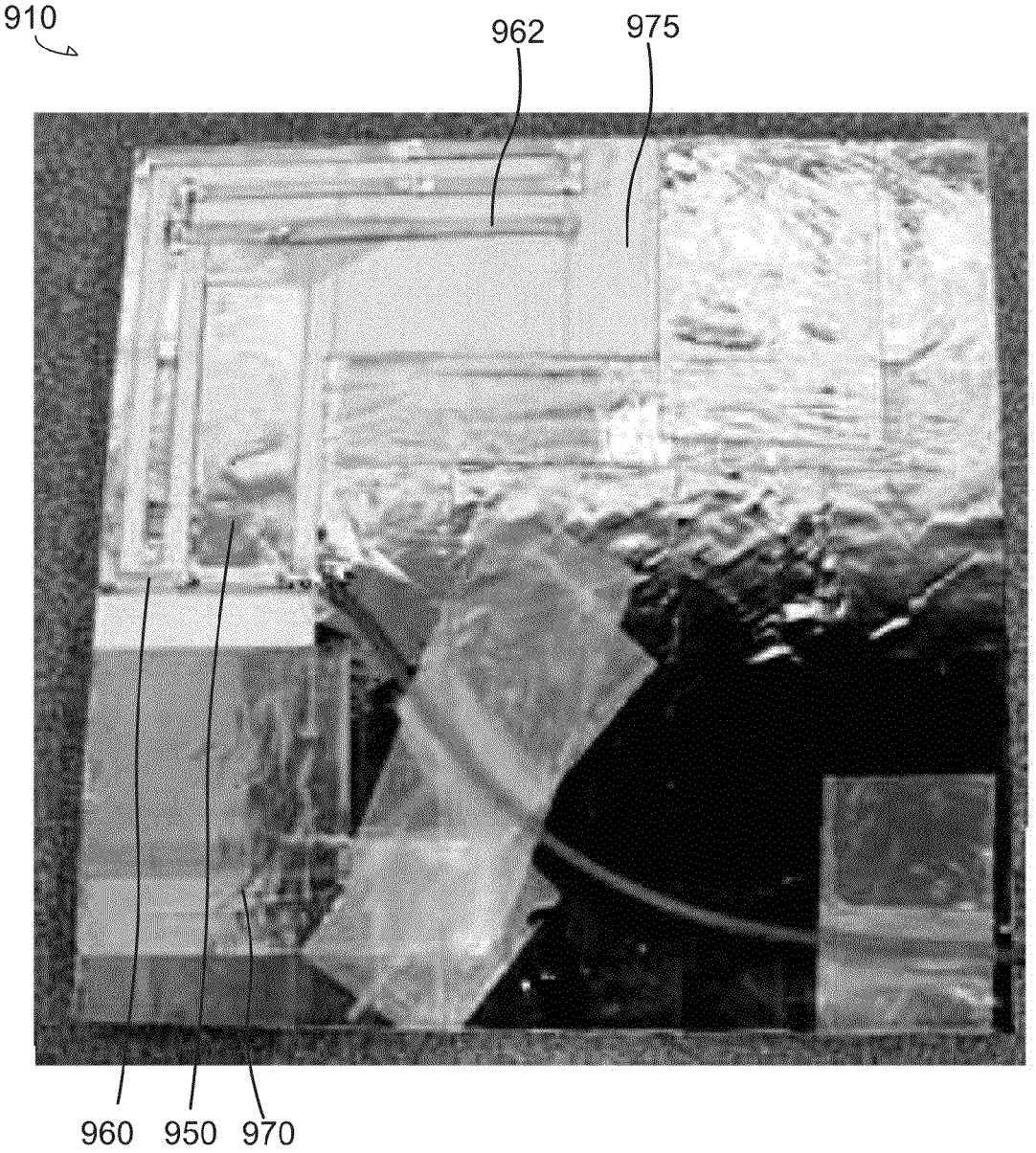
FIG. 9 includes a photograph of an illustrative example of a multi-band planar antenna that can include a stub.

FIG. 9 includes a photograph of an illustrative example of a multi-band planar antenna 910 that can include a folded conductive strip portion 960 conductively coupled to a planar loading portion 950. The antenna 910 can be located laterally nearby a planar return portion 970. The antenna 910 can include a bend in the folded conductive strip portion 960, such as to enhance polarization diversity of radiation from the antenna 910. In an example, a stub 962 can be included such as to adjust one or more ranges of operating frequencies to provide a specified range of operating frequencies. One or more of the folded conductive strip portion 960, the planar loading portion 950, the planar return portion 970, or the stub 962 can be located on or within a planar dielectric portion 975 (e.g., a dielectric foam in the example of FIG. 9). In an example, the dielectric portion 975 can include a dielectric material layer comprising a portion of a printed circuit board (PCB) assembly, or one or more other dielectric materials.

Figure 10:
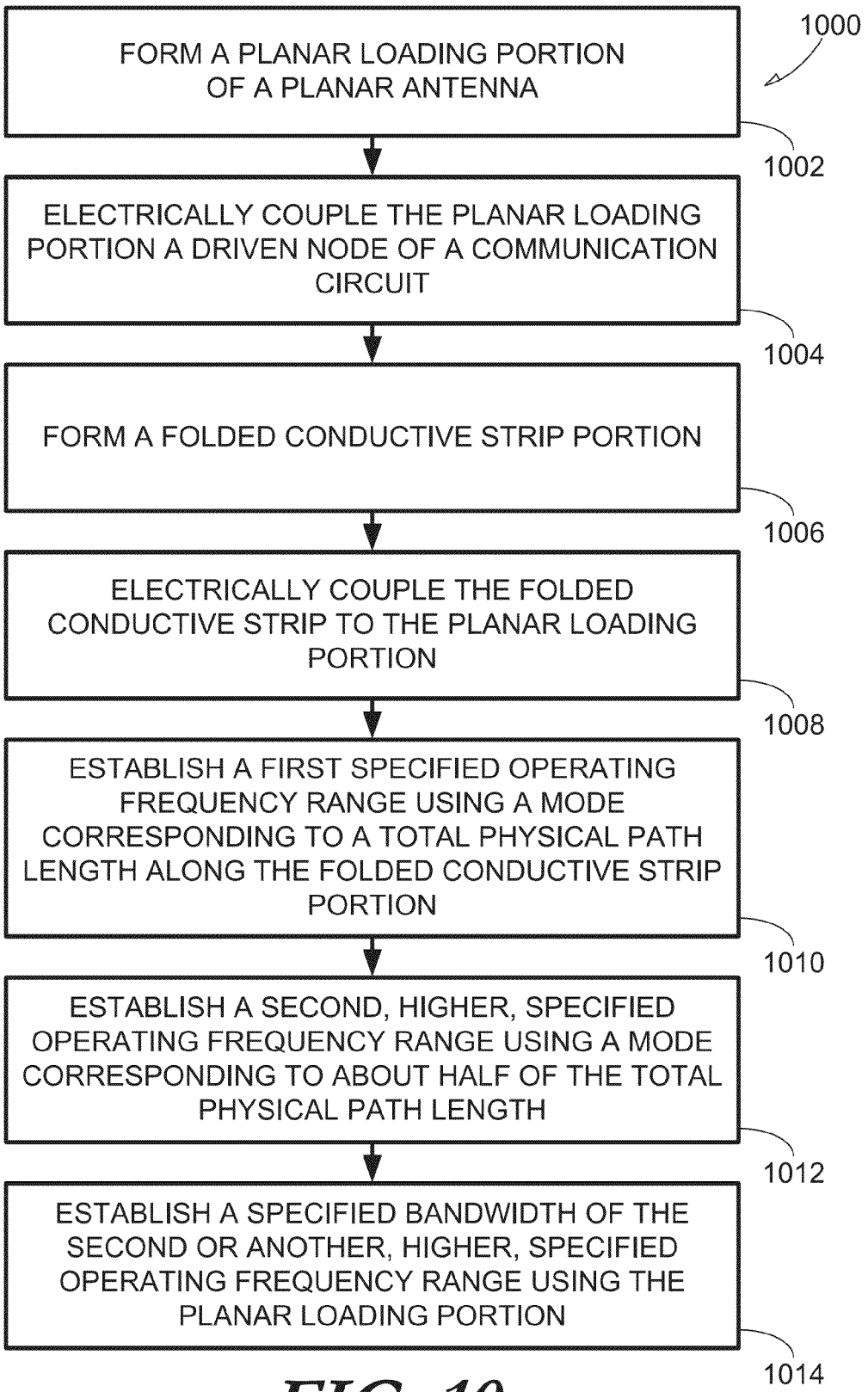
FIG. 10 illustrates generally a technique that can include forming a multi-band planar antenna that can include a planar loading portion.

FIG. 10 illustrates generally a technique 1000 (e.g., a method, or a series of instructions that can be performed by an apparatus) that can include forming a multi-band planar antenna, such as included in one or more of the examples above or below. At 1002, a planar loading portion can be formed, such as via stamping, etching, or using one or more other techniques. At 1004, the planar loading portion can be coupled to a driven node of a wireless communication circuit, such as a circuit configured for communication with one or more of an implantable or ambulatory medical device, a cellular or wireless network, a nearby or remotely located programmer or patient monitoring assembly, or one or more other assemblies.

At 1006, a folded conductive strip portion can be formed, such as using one or more of the fabrication techniques, or including apparatus, such as discussed in the examples above or below. At 1008, the folded conductive strip portion can be electrically coupled (e.g., conductively coupled) to the planar loading portion. At 1010, a first specified operating frequency range can be established such as using a mode corresponding to a total physical path length along the folded conductive strip portion of the antenna. At 1012, a second, higher, specified operating frequency range can be established using a mode corresponding to about half the total physical path length along the folded conductive strip portion of the antenna. At 1014, the planar loading portion can be used, at least in part, to establish a specified bandwidth of the second or another, higher operating frequency range.

Figure 11:
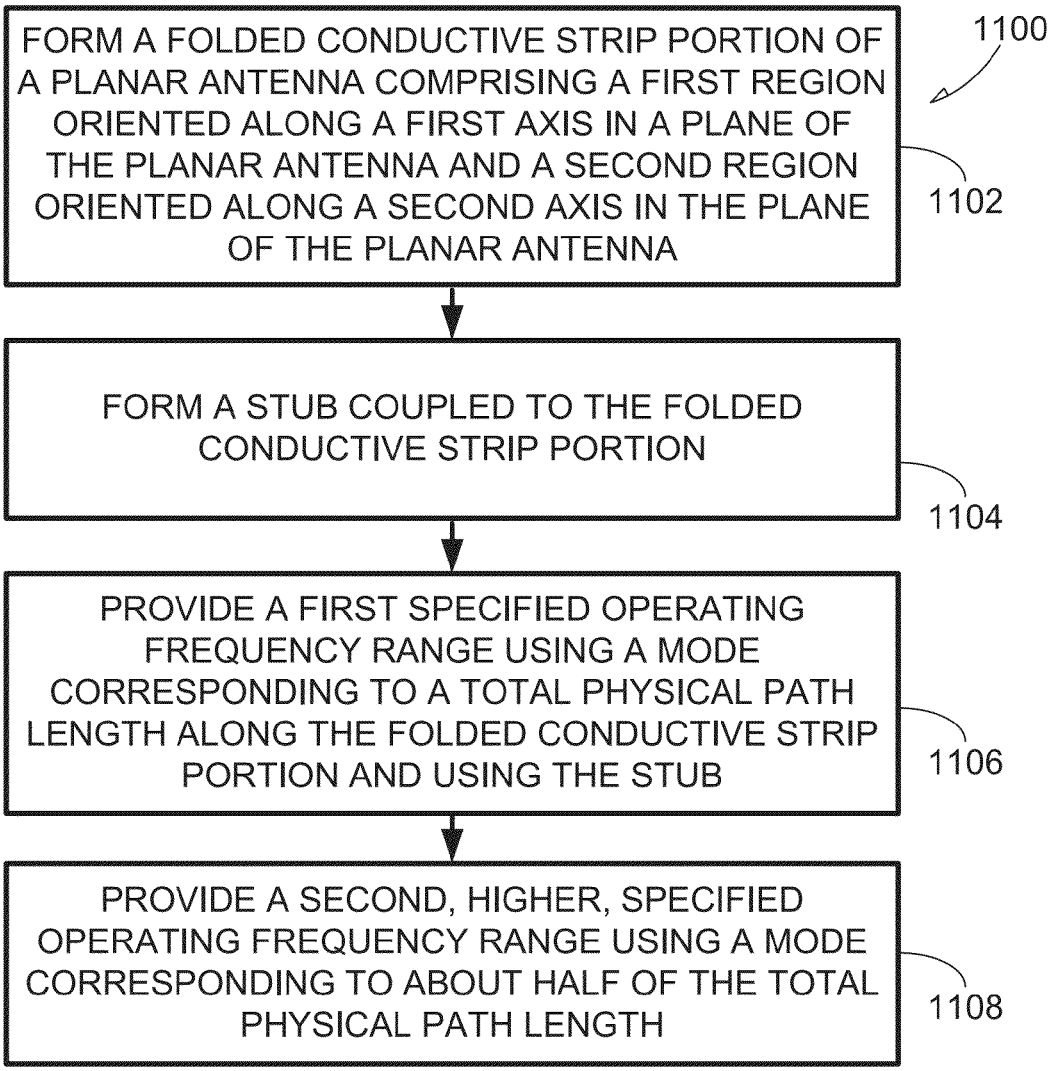
FIG. 11 illustrates generally a technique that can include forming a multi-band planar antenna that can include a first region along a first axis and a second region along a second axis.

FIG. 11 illustrates generally a technique 1100 that can include forming a multi-band planar antenna, such as included in one or more of the examples above or below, that can include a first region along (e.g., parallel to) a first axis and a second region along (e.g., parallel to) a second axis. At

1102, a folded conductive strip portion can be formed, such as including a first region oriented along a first axis in a plane of the planar antenna, and a second region oriented along a second axis in the plane of the planar antenna. At 1104, a stub can be formed, such as used at least in part to tune a fundamental mode of operation of the antenna. For example, the stub can be conductively coupled to the folded conductive strip portion.

In an example, the folded conductive strip portion can be coupled to a driven node of a communication circuit. For example, the folded conductive strip portion can, but need not, be coupled to the communication circuit via a planar loading portion. At 1106, a first specified operating frequency range can be provided, such as using a mode corresponding to a total physical path length along the folded conductive strip portion. In an example, the folded conductive strip can, but need not, be coupled to a stub, and a first specified operating frequency range can be provided by the total physical path length along the folded conductive strip portion and using the stub.

At 1108, a second, higher specified operating frequency range can be provided using a mode corresponding to about half of the total physical path length of the folded conductive strip portion. In an example, the technique 1100 can include forming an antenna that can provide two or more distinct specified operating frequency ranges.

VARIOUS NOTES & EXAMPLES

In an example, one or more of the folded conductive strip portions including one or more of the first through fourth segments, the planar loading portion, the planar return portion, or the stub, of any of the examples above or below, can be etched, stamped, deposited or otherwise formed using various techniques, such as comprising a conductive or metal layer (e.g., one or more of copper, aluminum, tungsten, or other conductor) located on or within a dielectric layer included as a portion of a printed circuit board (PCB) assembly. The printed circuit board assembly dielectric layer can include one or more of a glass-epoxy laminate, a ceramic material, a ceramic-loaded polymer material, a polytetrafluoroethylene (PTFE) material, or one or more other materials or laminated assemblies.

In an example, the feed region at a corner location of the planar return portion (or another feed region) of any of the examples above or below can be conductively coupled to an antenna port included as a portion of a wireless communication circuit. Such a conductive coupling can include a coaxial feed, or other transmission line or waveguiding structure, such as including a driven node and a reference node. The wireless communication circuit can be located on a PCB assembly that can be commonly-shared with the antenna or the wireless communication circuit can be located elsewhere such as connected to the antenna via a cable or another conductive or reactive coupling. In an example, the feed region of any of the examples above or below can include a connector or other portion configured for coupling the antenna to the wireless communication circuit (e.g., a coaxial connector, an array of solderable or weld-able pads, or one or more other electrical interconnections).

The examples above and below can include linear segments and right angles comprising the folded conductive strip portions. However, other segment shapes or transitions can be used, such as including arc-shaped or otherwise curved segments, rounded corners, or chamfered corners, for example.

Example 1 includes subject matter (such as an apparatus) comprising a planar antenna for wireless information transfer, the planar antenna including a planar loading portion electrically coupled to a driven node of a wireless communication circuit, the planar loading portion including an edge distal to the driven node of the wireless communication circuit, and a folded conductive strip portion coupled to the planar loading portion, the folded conductive strip portion comprising at least two segments laterally offset from each other and at least partially laterally overlapping with each other, the folded conductive strip portion configured to establish a first specified operating frequency range at or near resonance using a mode corresponding to a total physical path length along the folded conductive strip portion, and configured to establish a second, higher, specified operating frequency range at or near resonance using a mode corresponding to about half of the total physical path length, the planar loading portion configured to establish a specified bandwidth of the second or another, higher, specified operating frequency range, leaving the first specified operating frequency range substantially unchanged.

In Example 2, the subject matter of Example 1 can optionally include a folded conductive strip portion comprising a first conductive segment coupled to the planar loading portion, a second conductive segment coupled to the first segment, a third conductive segment coupled to the second segment, and a fourth conductive segment coupled to the third segment.

In Example 3, the subject matter of one or any combination of Examples 1-2 can optionally include a folded conductive strip portion including a specified physical width, the first segment less in length than about three times the physical width of the folded conductive strip portion.

In Example 4, the subject matter of one or any combination of Examples 1-3 can optionally include a folded conductive strip portion including a specified physical width, the third segment less in length than about the physical width of the folded conductive strip portion.

In Example 5, the subject matter of one or any combination of Examples 1-4 can optionally include a first specified operating frequency range including a Medical Implant Communications Service (MICS) frequency range from about 402 MHz to about 405 MHz, the second frequency range including a first Industrial, Scientific, and Medical (ISM) frequency range from about 902 MHz to about 928 MHz, another, higher, specified frequency range including a frequency range from about 1700 MHz to about 1900 MHz, and the planar loading portion is configured to establish a specified bandwidth including a range from about 1700 MHz to about 1900 MHz.

In Example 6, the subject matter of one or any combination of Examples 1-5 can optionally include a physical length of the planar loading portion that is about a quarter of an effective wavelength, the effective wavelength corresponding to an intermediate frequency between the first and second specified operating frequency ranges.

In Example 7, the subject matter of one or any combination of Examples 1-6 can optionally include a physical width of the planar loading portion configured to establish the specified bandwidth of the second or another, higher, specified operating frequency range.

In Example 8, the subject matter of one or any combination of Examples 1-7 can optionally include a planar loading portion that is rectangular and includes a physical width that is larger than a physical width of the folded conductive strip portion.

In Example 9, the subject matter of one or any combination of Examples 1-8 can optionally include a planar dielectric portion, the planar loading portion and the folded conductive strip portion located on commonly-shared surface of the planar dielectric portion.

In Example 10, the subject matter of one or any combination of Examples 1-9 can optionally include a planar return portion, the planar return portion coupled to a return node of the wireless communication circuit.

In Example 11, the subject matter of one or any combination of Examples 1-10 can optionally include a planar return portion coupled to the wireless communication circuit at or near a corner location.

In Example 12, the subject matter of one or any combination of Examples 1-11 can optionally include a planar return portions coupled to the wireless communication circuit at or near a midpoint of a lateral edge of the planar return portion.

In Example 13, the subject matter of one or any combination of Examples 1-12 can optionally include a planar antenna configured for wireless transfer of information electromagnetically between the planar antenna and an implantable medical device using one or more of the first, second, or another, higher, specified range of operating frequencies, and using the wireless communication circuit.

Example 14 can include, or can optionally be combined with the subject matter of one or any combination of Examples 1-13 to include, subject matter (such as an apparatus) comprising an external assembly including a wireless communication circuit configured for wireless information transfer between an implantable medical device and the external assembly, a planar antenna coupled to the wireless communication circuit, the planar antenna configured for wireless information transfer between an implantable medical device and an external assembly, the planar antenna comprising a planar loading portion electrically coupled to a driven node of a wireless communication circuit, the planar loading portion including an edge distal to the driven node of the wireless communication circuit, a folded conductive strip portion coupled to the planar loading portion, the folded conductive strip portion comprising at least two segments laterally offset from each other and at least partially laterally overlapping with each other, the folded conductive strip portion configured to establish a first specified operating frequency range at or near resonance using a mode corresponding to a total physical path length along the folded conductive strip portion, and configured to establish a second, higher, specified operating frequency range at or near resonance using a mode corresponding to about half of the total physical path length, the planar loading portion configured to establish a specified bandwidth of the second or another, higher, specified operating frequency range, leaving the first specified operating frequency range substantially unchanged, and a physical length of the planar loading portion about a quarter of an effective wavelength, the effective wavelength corresponding to an intermediate frequency between the first and second specified operating frequency ranges.

Example 15 can include, or can optionally be combined with the subject matter of one or any combination of Examples 1-14 to include, subject matter (such as a method, a means for performing acts, or a machine-readable medium including instructions that, when performed by the machine, cause the machine to perform acts) comprising forming a planar loading portion of a planar antenna, electrically coupling the planar loading portion to a driven node of a wireless communication circuit, the planar loading portion including an edge distal to the driven node of the wireless communication circuit, forming a folded conductive strip portion, electrically coupling the folded conductive strip portion to the planar loading portion, the folded conductive strip portion comprising at least two segments laterally offset from each other and at least partially laterally overlapping with each other, establishing a first specified operating frequency range at or near resonance for the planar antenna using a mode corresponding to a total physical path length along the folded conductive strip portion, establishing a second, higher, specified operating frequency range at or near resonance for the planar antenna using a mode corresponding to about half of the total physical path length, and using the planar loading portion, establishing a specified bandwidth of the second or another, higher, specified operating frequency range, leaving the first specified operating frequency range substantially unchanged.

In Example 16, the subject matter of Example 15 can optionally include a folded conductive strip portion comprising a first conductive segment coupled to the planar loading portion, a second conductive segment coupled to the first segment, a third conductive segment coupled to the second segment, and a fourth conductive segment coupled to the third segment.

In Example 17, the subject matter of one or any combination of Examples 15-16 can optionally include a folded conductive strip portion including a specified physical width, the first segment less in length than about three times the physical width of the folded conductive strip portion.

In Example 18, the subject matter of one or any combination of Examples 15-17 can optionally include a physical length of the planar loading portion that is about a quarter of an effective wavelength, the effective wavelength corresponding to an intermediate frequency between the first and second specified operating frequency ranges.

In Example 19, the subject matter of one or any combination of Examples 15-18 can optionally include forming a planar return portion, the planar return portion coupled to a return node of the wireless communication circuit.

In Example 20, the subject matter of one or any combination of Examples 15-19 can optionally include wirelessly transferring information electromagnetically between the planar antenna and an implantable medical device using one or more of the first, second, or another, higher, specified range of operating frequencies, and using the wireless communication circuit.

Example 21 can include, or can optionally be combined with any portion or combination of any portions of any one or more of Examples 1-20 to include, subject matter that can include means for performing any one or more of the functions of Examples 1-20, or a machine-readable medium including instructions that, when performed by a machine, cause the machine to perform any one or more of the functions of Examples 1-20.

These non-limiting examples can be combined in any permutation or combination.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A planar antenna for wireless information transfer, the planar antenna comprising:

a planar loading portion electrically coupled to a driven node of a wireless communication circuit, the planar loading portion including an edge distal to the driven node of the wireless communication circuit; and a folded conductive strip portion coupled to the planar loading portion, the folded conductive strip portion comprising at least two segments laterally offset from each other and at least partially laterally overlapping with each other;

wherein the folded conductive strip portion is configured to establish a first specified operating frequency range at or near resonance using a mode corresponding to a total physical path length along the folded conductive strip portion, and configured to establish a second, higher, specified operating frequency range at or near resonance using a mode corresponding to about half of the total physical path length; and wherein the planar loading portion is configured to establish a specified bandwidth of the second or another, higher, specified operating frequency range, leaving the first specified operating frequency range substantially unchanged.

2. The planar antenna of claim 1, wherein the folded conductive strip portion comprises:

a first conductive segment coupled to the planar loading portion;

a second conductive segment coupled to the first segment;

a third conductive segment coupled to the second segment; and a fourth conductive segment coupled to the third segment.

3. The planar antenna of claim 2, wherein the folded conductive strip portion includes a specified physical width; and wherein the first segment is less in length than about three times the physical width of the folded conductive strip portion.

4. The planar antenna of claim 2, wherein the folded conductive strip portion includes a specified physical width; and wherein the third segment is less in length than about the physical width of the folded conductive strip portion.

5. The planar antenna of claim 1, wherein the first specified operating frequency range includes a Medical Implant Communications Service (MICS) frequency range from about 402 MHz to about 405 MHz;

wherein the second frequency range includes a first Industrial, Scientific, and Medical (ISM) frequency range from about 902 MHz to about 928 MHz;

wherein another, higher, specified frequency range includes a frequency range from about 1700 MHz to about 1900 MHz;

wherein the planar loading portion is configured to establish a specified bandwidth including a range from about 1700 MHz to about 1900 MHz.

6. The planar antenna of claim 1, wherein a physical length of the planar loading portion is about a quarter of an effective wavelength, the effective wavelength corresponding to an intermediate frequency between the first and second specified operating frequency ranges.

7. The planar antenna of claim 6, wherein a physical width of the planar loading portion is configured to establish the specified bandwidth of the second or another, higher, specified operating frequency range.

8. The planar antenna of claim 1, wherein the planar loading portion is rectangular and includes a physical width that is larger than a physical width of the folded conductive strip portion.

9. The planar antenna of claim 1, comprising a planar dielectric portion; and wherein the planar loading portion and the folded conductive strip portion are located on commonly-shared surface of the planar dielectric portion.

10. The planar antenna of claim 1, comprising a planar return portion, the planar return portion coupled to a return node of the wireless communication circuit.

11. The planar antenna of claim 10, wherein the planar return portion is coupled to the wireless communication circuit at or near a corner location.

12. The planar antenna of claim 10, wherein the planar return portion is coupled to the wireless communication circuit at or near a midpoint of a lateral edge of the planar return portion.

13. The planar antenna of claim 1, wherein the planar antenna is configured for wireless transfer of information electromagnetically between the planar antenna and an implantable medical device using one or more of the first, second, or another, higher, specified range of operating frequencies, and using the wireless communication circuit.

14. An apparatus, comprising:

An external assembly comprising:

a wireless communication circuit configured for wireless information transfer between an implantable medical device and the external assembly; and a planar antenna coupled to the wireless communication circuit, the planar antenna configured for wireless information transfer between an implantable medical device and an external assembly, the planar antenna comprising:

a planar loading portion electrically coupled to a driven node of a wireless communication circuit, the planar loading portion including an edge distal to the driven node of the wireless communication circuit; and a folded conductive strip portion coupled to the planar loading portion, the folded conductive strip portion comprising at least two segments laterally offset from each other and at least partially laterally overlapping with each other;

wherein the folded conductive strip portion is configured to establish a first specified operating frequency range at or near resonance using a mode corresponding to a total physical path length along the folded conductive strip portion, and configured to establish a second, higher, specified operating frequency range at or near resonance using a mode corresponding to about half of the total physical path length;

wherein the planar loading portion is configured to establish a specified bandwidth of the second or another, higher, specified operating frequency range, leaving the first specified operating frequency range substantially unchanged; and wherein a physical length of the planar loading portion is about a quarter of an effective wavelength, the effective wavelength corresponding to an intermediate frequency between the first and second specified operating frequency ranges.

15. A method, comprising:

forming a planar loading portion of a planar antenna;

electrically coupling the planar loading portion to a driven node of a wireless communication circuit, the planar loading portion including an edge distal to the driven node of the wireless communication circuit; and forming a folded conductive strip portion;

electrically coupling the folded conductive strip portion to the planar loading portion, the folded conductive strip portion comprising at least two segments laterally offset from each other and at least partially laterally overlapping with each other;

establishing a first specified operating frequency range at or near resonance for the planar antenna using a mode corresponding to a total physical path length along the folded conductive strip portion;

establishing a second, higher, specified operating frequency range at or near resonance for the planar antenna using a mode corresponding to about half of the total physical path length; and using the planar loading portion, establishing a specified bandwidth of the second or another, higher, specified operating frequency range, leaving the first specified operating frequency range substantially unchanged.

16. The method of claim 15, wherein the folded conductive strip portion comprises:

a first conductive segment coupled to the planar loading portion;

a second conductive segment coupled to the first segment;

a third conductive segment coupled to the second segment; and a fourth conductive segment coupled to the third segment.

17. The method of claim 16, wherein the folded conductive strip portion includes a specified physical width; and wherein the first segment is less in length than about three times the physical width of the folded conductive strip portion.

18. The method of claim 15, wherein a physical length of the planar loading portion is about a quarter of an effective wavelength, the effective wavelength corresponding to an intermediate frequency between the first and second specified operating frequency ranges.

19. The method of claim 15, comprising forming a planar return portion, the planar return portion coupled to a return node of the wireless communication circuit.

20. The method of claim 15, comprising wirelessly transferring information electromagnetically between the planar antenna and an implantable medical device using one or more of the first, second, or another, higher, specified range of operating frequencies, and using the wireless communication circuit.

* * * * *